US005629473A

United States Patent [19]

Hayami

[11] Patent Number: 5,629,473

[45] Date of Patent: May 13, 1997

[54] OXYGEN CONCENTRATION DETECTION DEVICE

[75] Inventor: Toshifumi Hayami, Kariya, Japan

[73] Assignee: Nippondenso Co., Ltd., Kariya, Japan

[21] Appl. No.: 550,465

[22] Filed: Oct. 30, 1995

[30] Foreign Application Priority Data

Oct. 31, 1994 [JP] Japan ..... 6-265901

[51] Int. Cl.[6] ..... F02D 41/14

[52] U.S. Cl. ..... 73/23.31; 73/118.1

[58] Field of Search ..... 73/23.31, 116, 73/117.2, 117.3, 118.1, 118.2

[56] References Cited

U.S. PATENT DOCUMENTS

| | | | |
|---|---|---|---|
| 5,325,711 | 7/1994 | Hamburg et al. | 73/118.1 |
| 5,476,001 | 12/1995 | Hoetzel et al. | 73/23.31 |
| 5,493,896 | 2/1996 | Riegel | 73/23.31 |
| 5,513,522 | 5/1996 | Seki et al. | 73/23.31 |

FOREIGN PATENT DOCUMENTS

| | | |
|---|---|---|
| 52-46890 | 4/1977 | Japan . |
| 58-139548 | 9/1983 | Japan . |
| 62-131941 | 6/1987 | Japan . |
| 4-224250 | 8/1992 | Japan . |
| 6-174682 | 6/1994 | Japan . |

*Primary Examiner*—George M. Dombroske
*Attorney, Agent, or Firm*—Cushman, Darby & Cushman IP Group of Pillsbury Madison & Sutro, LLP

[57] ABSTRACT

Erroneous malfunction determination of an oxygen sensor is avoided by consideration of combustible substance penetrating to an air electrode side of the oxygen sensor. The combustible substance is determined whether it has penetrated to the air electrode of the oxygen sensor. If it is determined so, then it is determined whether the oxygen deficiency has disappeared, and the sensor malfunction determination operation is disabled until the oxygen deficiency at the air electrode is eliminated. At the same time, malfunction determination is also disabled.

11 Claims, 16 Drawing Sheets

OXYGEN CONCENTRATION DETECTION DEVICE

CROSS REFERENCE TO RELATED APPLICATION

This application is based on and claims priority of Japanese Patent Application No. 6-265901 filed on Oct. 31, 1994, the content of which is incorporated herein by reference.

BACKGROUND OF THE INVENTION

1. Field of the Invention

This invention relates to an oxygen concentration detection device which is equipped with a function to detect whether an oxygen sensor installed in an exhaust pipe is malfunctioning or not.

2. Description of Related Art

In conventional A/F ratio feedback control systems which feed back the A/F ratio based on the output signal from an oxygen sensor installed in the exhaust pipe of an automobile, it is determined that the oxygen sensor is malfunctioning when the oxygen sensor output drops below a specified oxygen sensor output level or becomes negative to generate a warning to a driver, as disclosed in Japanese Patent Laid-open No. SHO58-139548, SHO52-46890 and HEI4-224250.

Oxygen sensors which are generally used for A/F ratio feedback control are equipped with an exhaust electrode which contacts exhaust gases flowing through the exhaust pipe and an air electrode which contacts the air. Following this, a voltage is generated between the both electrodes according to the oxygen concentration differential between the air and the exhaust gas electrodes to detect the oxygen concentration in exhaust gas emissions based on the voltages. Normally, the oxygen concentration at the air electrode side is identical to that of the air in the atmosphere. However, when combustible substances come into contact with the air electrode, the oxygen concentration decreases rapidly due to combustion (oxidation reaction) of the combustible substances through exhaust gas heat, which causes an oxygen deficiency to occur at the air electrode side. At the same time, the oxygen concentration on the air electrode side and the exhaust gas electrode side is reversed, which causes the electrical output of the oxygen sensor to become negative, even when the oxygen sensor is not malfunctioning. This may lead to the erroneous determination that the sensor is malfunctioning.

As combustible substances that way give rise to errors such as above, factors such as dust in the air and residual fuel in exhaust gas emissions are considered as potential causes. Residual fuel contained in exhaust gas can adhere to the surface of the exhaust electrode of the oxygen sensor exposed inside the exhaust pipe penetrate a sensor seal portion and finally leak outside to enter into the air electrode. This phenomenon has been proven through experiments by the inventor of the present invention. However, from the viewpoint of the structure of oxygen sensors, it is difficult to protect the air electrode from coming into contact with combustible substances. Under these circumstances, the most important technical matter remaining to be solved at the present stage of development is how to prevent the oxygen sensor from being erroneously detected as malfunctioning due to combustible substances in exhaust gas emissions.

SUMMARY OF THE INVENTION

The present invention is intended to solve the above-mentioned problem and has its objective to prevent the erroneous detection of oxygen sensors as malfunctioning when combustible substances enters into the air electrode side of the oxygen sensor.

In order to achieve the above-mentioned objective, an oxygen concentration detection device according to this invention is constructed by an oxygen sensor installed in an exhaust pipe and equipped with an exhaust electrode which makes contact with exhaust gas emissions and an air electrode which makes contact with the air to detect the oxygen concentration, means to detect whether the sensor is malfunctioning or not based on the oxygen sensor output, means to detect if the oxygen deficiency at the air electrode of the oxygen sensor is eliminated or not, and means to cancel a determination of sensor malfunction from the time when the oxygen deficiency at the air electrode side has been determined until it is detected that the oxygen deficiency has been eliminated.

Preferably, means to detect whether combustible substances have penetrated the air electrode side of the oxygen sensor or not is provided to detect whether the oxygen deficiency at the air electrode side is eliminated or not.

In addition, it is preferable that means to indicate or warn when the oxygen sensor has been detected as malfunctioning and means to cancel such indication when the oxygen deficiency state at the air electrode side of the oxygen sensor is not detected are provided.

In this instance, it is preferred that means for memorizing information of sensor malfunction detected by the sensor malfunction detection means and means to clear the memory of information of previously detected oxygen sensor malfunction after the oxygen deficiency of the air electrode side of the oxygen sensor has once been eliminated are provided.

Provided, preferably, is means to detect the amount of fuel injection at engine startup, and whether combustible substances has penetrated to the air electrode of the oxygen sensor is determined based on the amount of fuel injection.

Also, the penetration of combustible substances can be detected based on whether the electrical output for the oxygen sensor is negative or not.

From the fact that the oxygen deficiency state usually occurs when the temperature of the oxygen sensor increases to a certain level, penetration of combustible substances to the air electrode side of the oxygen sensor may be determined based on whether or not the oxygen sensor output remains below a specified level for a specified period of time after the oxygen sensor temperature has reached a specified temperature.

Alternatively whether the oxygen deficiency has been eliminated can be determined based on one or more of oxygen sensor powering-up time, engine coolant temperature, exhaust gas temperature, or engine load.

Still alternatively, whether the oxygen deficiency has been eliminated or not may be determined based on whether the oxygen sensor temperature rises above the specified temperature level for the specified period of time.

Still alternatively, whether the oxygen deficiency at the air electrode side of the oxygen sensor has been eliminated or not may be determined based on whether the oxygen sensor output returns to the normal output range or not after the oxygen sensor temperature has reached the specified temperature level.

BRIEF DESCRIPTION OF THE DRAWINGS

In the accompanying drawings:

FIG. 2A shows a cross-sectional view of IIA—IIA of FIG. 2B while

DETAILED DESCRIPTION OF THE PREFERRED EMBODIMENTS

The present invention will be described in detail with reference to the accompanying drawings.

Figure 1:
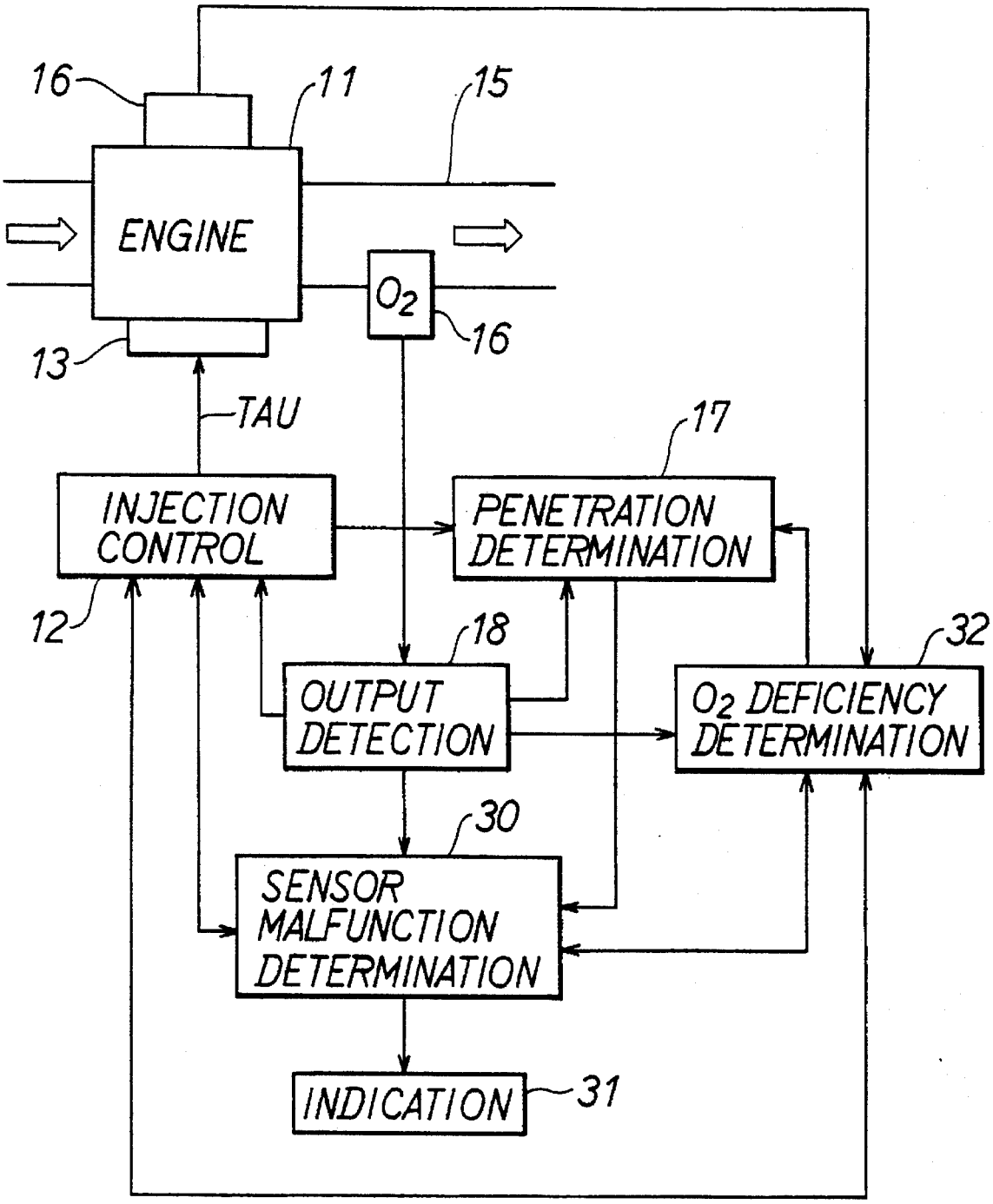
FIG. 1 is a block diagram showing the overview of a system according to a first embodiment of this invention.
Figure 3:
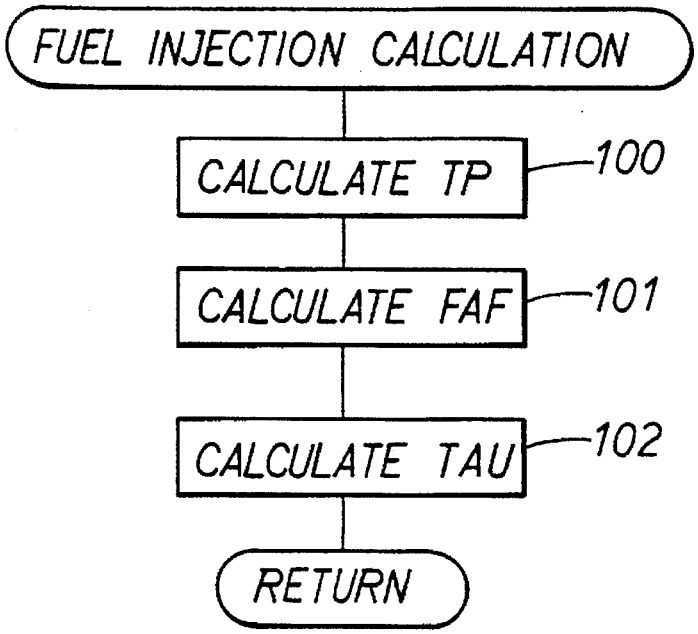
FIG. 3 is a flow chart showing the processing flow of the fuel injection amount calculation routine.

In FIG. 1, fuel is injected to the engine 11 by a fuel injector 13 controlled by a fuel injection control means 12. The fuel injection control means 12 calculates the amount of fuel injection TAU using the routine shown in FIG. 3, based on information sent from various sensors, such as the engine rpm sensor, air flow sensor and throttle opening sensor in the known manner.

Initially, the fuel injection control means 12 calculates the basic fuel injection amount TP (step 100) to realize the specified stoichiometric A/F ratio (generally, the A/F ratio is 14.7), then the A/F ratio correction factor FAF is calculated (step 101). Following this, the amount of fuel injection TAU is calculated by the following formula based on the basic fuel injection amount TP and the A/F ratio correction factor FAF (step 102).

$$TAU=TP\times FAF\times FC+TV$$

FC: Various correction factors

TV: Invalid injection time for injector 13

Figure 4:
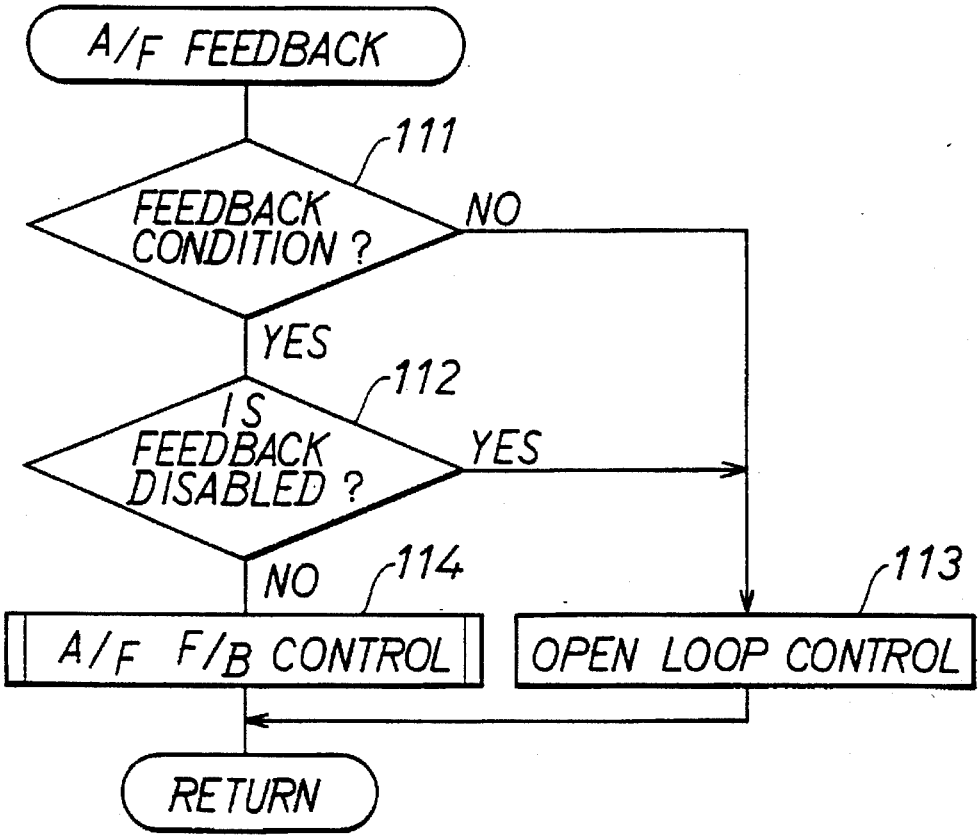
FIG. 4 is a flow chart showing the processing flow of the A/F ratio feedback routine.
Figure 5:
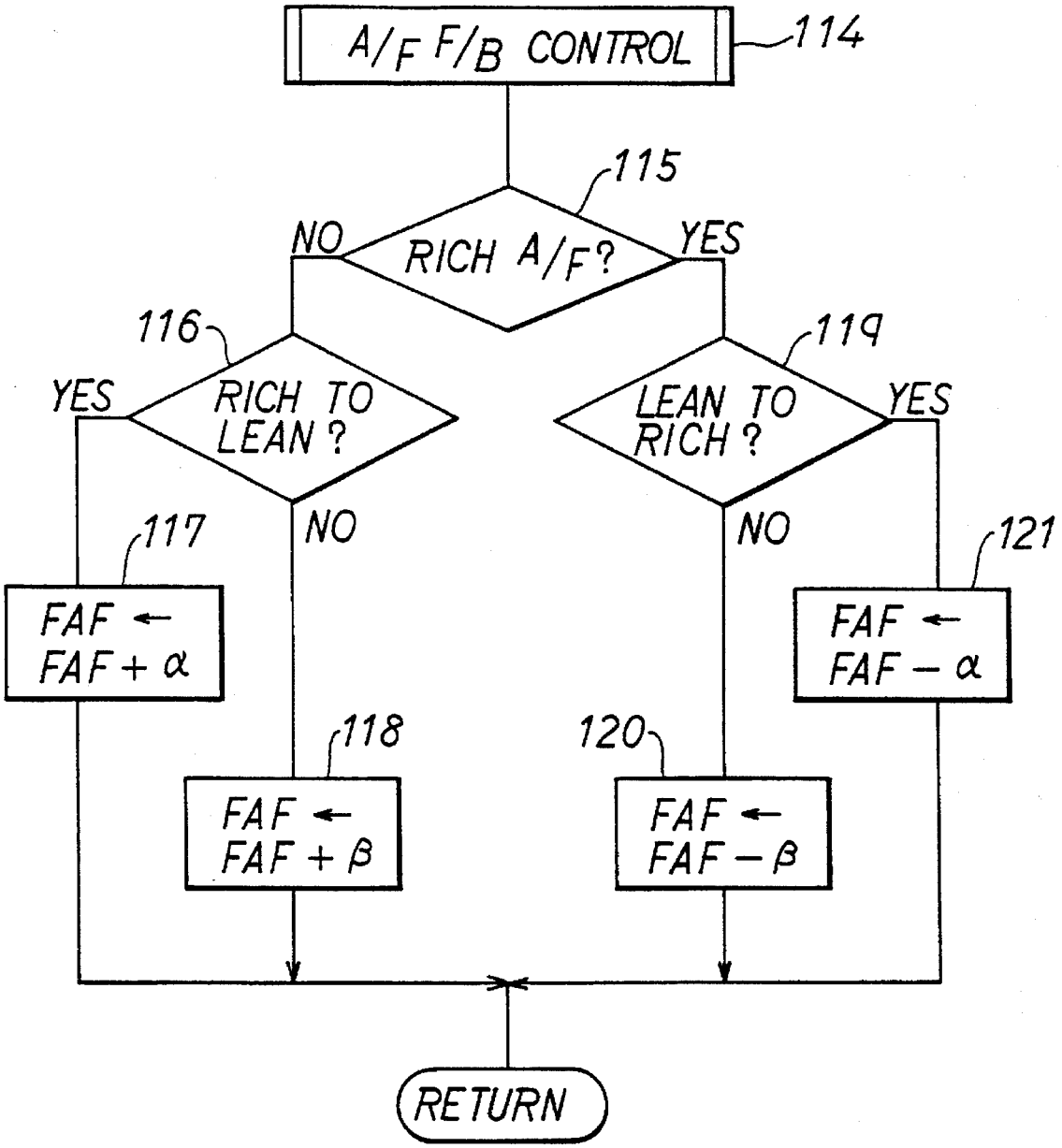
FIG. 5 is a flow chart showing the processing flow of the A/F feedback control routine.

The fuel injection control means 12 detects the output (oxygen concentration in exhaust gas) from an oxygen ($O_2$) sensor 16 installed in an exhaust pipe 15 by sensor output detection device 18 and determines whether current A/F ratio is rich or lean in relation to the target A/F ratio and performs feedback control for A/F ratio by the routines shown in FIGS. 4 and 5.

In step 111 in FIG. 4, whether feedback conditions are met or not is determined. The feedback conditions specified here are that the oxygen sensor 16 must be active (at high temperatures) and the engine coolant temperature must be above the specified level, etc. If the feedback conditions are met, the routine proceeds to step 112 where it is determined whether feedback is disabled or not. If feedback is disabled, open-loop control is performed (step 113), and if it is not disabled, A/F ratio feedback control (step 114) is performed. Whether or not feedback is disabled is determined by the feedback disabling routine in FIG. 8. While combustible substances are burning, the A/F ratio feedback control is disabled.

The A/F ratio feedback control first detects whether the current A/F ratio is rich or lean in step 115. If the ratio is detected to be rich, it is compared with the previous A/F ratio, then it is determined whether the A/F ratio was reversed from lean to rich (in step 119). If it is determined that the ratio was changed from lean to rich in step 119, the value obtained by deducting the skip amount $\alpha$ from the current A/F ratio correction factor is set as a new A/F ratio correction factor FAF (step 121). Conversely, if the A/F ratio was not reversed from lean to rich (i.e., the previous A/F ratio was rich and the current A/F ratio is also rich), the value obtained by deducting the amount of integration $\beta$ ($\alpha>\beta$) is set as the new A/F ratio correction factor FAF (step 120).

On the other hand, if the A/F ratio is determined to be lean in step 115, the routine moves on to step 116 where it is determined whether the A/F ratio was reversed from rich to lean. If it is determined to have been reversed from rich to lean, the value obtained by adding the skipped amount $\alpha$ to the current A/F ratio correction factor FAF is set as the new A/F ratio correction factor FAF (step 117). Conversely, if the A/F ratio was not reversed from rich to lean, the value obtained by adding the amount of integration $\beta$ to the current A/F correction factor FAF (step 118) is set.

Figure 2A:
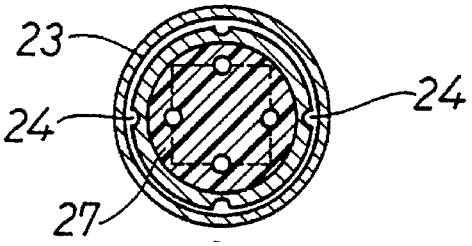
Figure 2B:
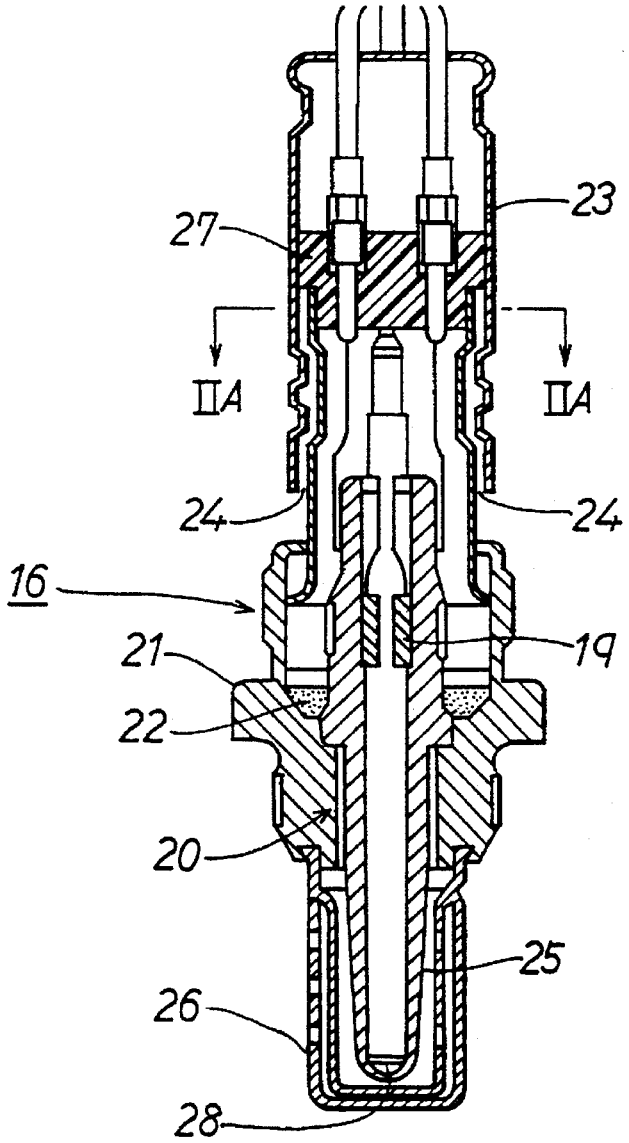
FIG. 2B shows a cross-sectional view of an oxygen sensor.

In contrast to this, combustible substance penetration determining means 17 shown in FIG. 1 decides whether combustible substances have penetrated an air electrode 19 of oxygen sensor 16 based on the information obtained by sensor output detection means 18, etc. In order to explain the mechanism by which combustible substances penetrate the air electrode 19 of the oxygen sensor 16, reference is made to the oxygen sensor 16 shown in FIGS. 2A and 2B.

The oxygen sensor 16 is mounted on the exhaust pipe 15 via a sensor holder 21. A sensor 20 which generates voltage according to the oxygen concentration in exhaust gas is fixed to the sensor holder 21 via a sensor seal 22. As the sensor seal 22 is required to provide thermal-resistance characteristics, it is made of compressed ceramic powder. The sensor 20 is in cylindrical shape with one side covered and the air electrode 19 is mounted on it. The air electrode 19 is positioned so that it makes contact with the air taken from a top cover 23 of an air intake 24 located over the sensor holder 21. A filter 27 is installed in the top cover 23.

Dust and other foreign matters contained in the air from the air intake 24 is filtered out by the filter 27.

In contrast, an exhaust electrode 25 is installed on the outer surface of the sensor 20 and part of exhaust gases flowing through the exhaust pipe 15 enters through perforations in a bottom cover 26 and to come in contact with the exhaust electrode 25. A heater 28 is installed at the lower internal surface of the sensor 20 which heats up the sensor 20 and shortens the time (power-up time) required for the sensor 20 to become operative.

Dust and foreign particles contained in the air, and grease (such as lubricants used for maintenance and residual fuel fluid) contained in the exhaust gases are considered as combustible substances which come in contact with and penetrate to the air electrode 19 of the oxygen sensor 16. Residual fuel fluid adheres to the surface of the exhaust electrode 19 of the oxygen sensor 16, then permeates the sensor seal 22 and oozes out to the air electrode side. This phenomenon was ascertained by the inventor of the invention. The phenomenon that residual fuel fluid is contained in exhaust gases occurs mainly at start-up of engine 11. Based on this phenomenon, residual fuel in exhaust gases also adheres to the exhaust electrode 25 of the oxygen sensor 16 mainly at engine start-up. Therefore, the more fuel is injected at start-up of engine 11, the more residual fuel adheres to the exhaust electrode 25 of the oxygen sensor 16. Consequently, the more residual fuel that oozes over along the surface of the exhaust electrode 25 penetrates to the side of air electrode 19.

Figure 6:
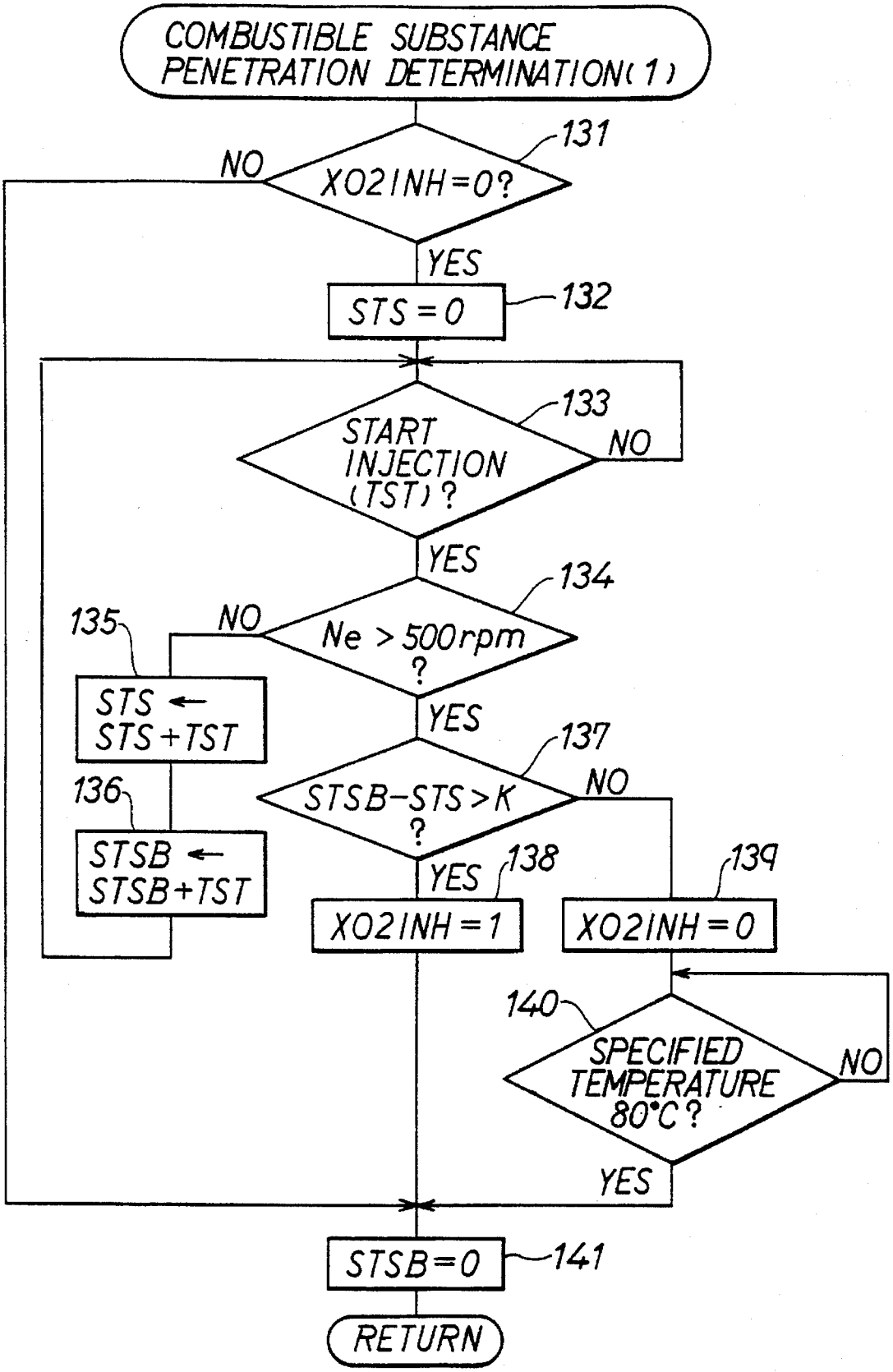
FIG. 6 is a flow chart showing the processing flow of combustible substance penetration determination routine (1)

Based on this relationship, in this embodiment, the amount of fuel injected on starting of the engine 11 is determined by the combustible substance penetration determination routine shown in FIG. 6 and whether combustible substances have penetrated to the air electrode 19 of the oxygen sensor 16 is determined based on the results of this determination.

In the routine shown in FIG. 6, whether combustible substance penetration flag XO2INH is set to "0" or not is determined in step 131. When X02INH=0 is set, it means that residual fuel (a combustible substance) has not penetrated to the air electrode 19,; when X02INH=1 is set, it means that residual fuel has penetrated to the air electrode 19. If X02INH=0 is determined (i.e., no residual fuel), the process routine moves on to step 132 and resets the STS (total amount of fuel injected at engine start-up) to "0" before the engine 11 starts, then sets to standby until the starter for the engine 11 is activated (step 133).

Later, after the engine 11 has started and fuel corresponding to the amount of fuel injected at engine start-up (TST) is injected, the routine determines whether the engine rpm Ne exceeds 500 rpm or not, [i.e., whether the engine 11 has started or not (step 134)]. If the engine 11 has not started successfully yet, the routine proceeds to step 135 wherein the total amount of fuel injected at start-up STS is added to TST. At the same time, TST is added to the total amount of fuel STSB which has been injected when the engine was previously started (step 136).

While the engine 11 is starting (the engine rpm level is Ne≦500 rpm), the processing in steps 133 to 136 is repeated and STS (the total amount of fuel injected at present starting) and the STSB (total amount of fuel injected at previous starting of the engine) are added up with TST at each injection. The reason why the STSB for the previous start-up is added is to take into account previous instances when the engine 11 failed to start previously (i.e., residual fuel is still adhering to the oxygen sensor 16). The STSB is then memorized in a RAM which is backed up by a battery (not shown in the figure) and this maintains the STSB used when the engine was started previously, even while the ignition switch is turned off.

On the other hand, when the engine rpm Ne exceeds 500 rpm, it is assumed that the engine 11 has started and the routine moves on to step 137 where it detects whether residual fuel has penetrated to the air electrode 19 of the oxygen sensor 16 based on the amount of fuel considered as adhering to the oxygen sensor 16 when the engine was started previously.

Now, explained is the criteria for detecting whether residual fuel has penetrated to the air electrode 19 or not. Conditions wherein residual fuel adhering to the surface of exhaust electrode 25 of the oxygen sensor 16 penetrates to the air electrode 19 are that: [1] the amount of fuel adhering to exhaust electrode 25 exceeds the specified amount (determined by step 137) and [2] the engine is kept stopped for a longer time than it takes for residual fuel on the electrode to permeate into the sensor seal 22.

According to the result of experiments conducted by the inventor of the invention, it took approximately 1 hour for the residual fuel to permeate into the sensor seal 22. Therefore, in order to detect where residual fuel is still adhering to the oxygen sensor 16, when the ignition switch is turned OFF after the engine has started (and before the specified temperature conditions required to evaporate fuel adhering to the oxygen sensor 16 are met), the STSB of step 136 (total amount of injected fuel) injected when the engine was previously started needs to be maintained without resetting to "0".

In step 137, in order to determine the conditions for [1] above, the amount of fuel adhering to the oxygen sensor 16 when the engine was started previously is estimated based on the value obtained by deducting the STS (the total amount of fuel injected when the engine was started this time) from the STSB (total amount of fuel injected when the engine was started before), then the value (STSB−STS) is compared with a specified value K. If STSB−STS>K is obtained, it is assumed that residual fuel penetrated to the air electrode 19 of the oxygen sensor 16 and the routine moves on to step 138 and sets combustible substance penetration flag X02INH to "1".

In contrast to this, if STSB−STS≦K, it means that the amount of residual fuel adhering to the oxygen sensor 16 is small and fuel penetrating to the air electrode 19 can be ignored, so the process proceeds to step 139 and resets combustible substance penetration flag X02INH to "0". In this instance, the routine sets to standby in step 140 and maintains the STSB memorized in the RAM which is backed up by the battery (without resetting to "0") until the specified temperature condition (i.e., the temperature required for fuel adhering to the oxygen sensor 16 to evaporate) is met. This is performed in order to cope with instances when the ignition switch is turned off before the temperature condition has been met. The specified temperature condition described here differs from the temperature condition for canceling the malfunction disable state (described later) and refers to the time required for residual fuel adhering to the oxygen sensor 16 to evaporate (for example, the engine coolant temperature must exceed 80° C.).

If the engine continues operating until the specified temperature condition is met in step 140, it is assumed that all the residual fuel adhering to the oxygen sensor 16 has evaporated, and the process moves on to step 141 wherein the STSB injected at engine start-up is reset to "0". Also, when the combustible substance penetration flag X02INH is set to "1" in step 138 (i.e., where it is determined that combustible substances exist), the routine moves on to step 141 and resets the STSB to "0". This is because fuel penetrating the air electrode 19 will burn out completely when the malfunction detection function is disabled.

The routine explained in FIG. 6 explained above illustrates the measures to be taken in instances when an oxygen deficiency arises at the air electrode 19 due to burning (oxidation) of fuel adhering to the exhaust electrode 25 of the oxygen sensor 16 at engine startup, at which point the amount of fuel adhering to the oxygen sensor 16 is estimated to predict occurrence of oxygen deficiency at the air electrode 19 and disable the malfunction detection function.

Combustible substances contained in the air such as dust, oil, etc., are considered as combustible substances that may penetrate to the air electrode 19 of the oxygen sensor 16. If dust, oil, etc., penetrate the air electrode 19 via air intake 24 of the oxygen sensor 16, an oxygen deficiency may also be created at the air electrode 19 as long as such substances are burning (oxidizing). When an oxygen deficiency arises at the air electrode 19, the oxygen concentration relationship between the air electrode 19 and exhaust electrode 25 becomes opposite to normal condition, causing the electrical output of the oxygen sensor 16 to become negative. When the oxygen deficiency at the air electrode 19 is detected by means of the electrical output for the oxygen sensor 16, the routine assumes that combustible substances have penetrated to the air electrode 19 and the malfunction detection function may be disabled.

Figure 7:
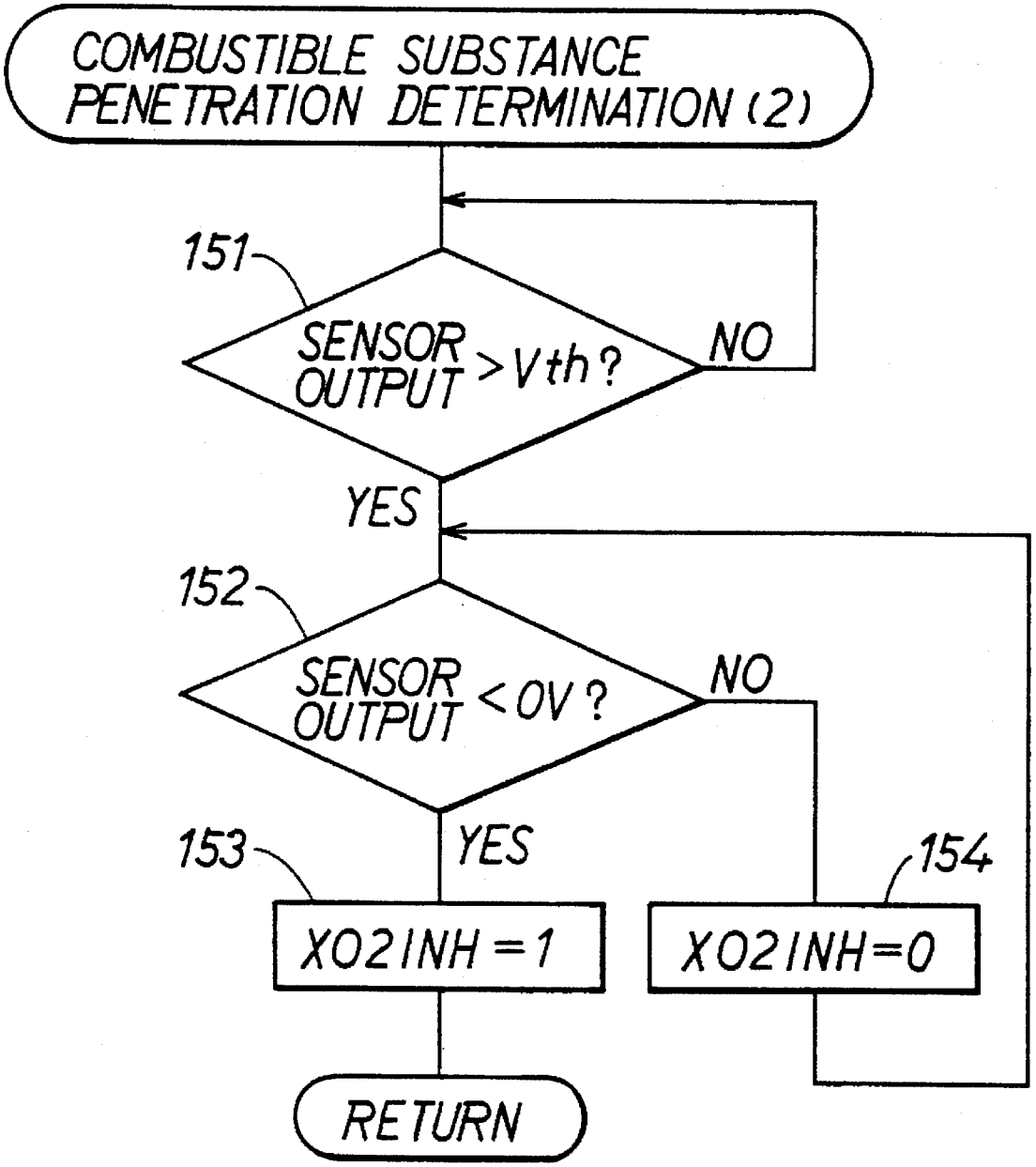
FIG. 7 is a flow chart showing the processing flow of combustible substance penetration determination routine (2)

Detection of penetration of combustible substances other than fuel is performed by the routine shown in FIG. 7. In this routine, initially in step 151, the output for the oxygen sensor 16 is compared with a specified active level voltage Vth (for example 0.4 to 0.5 V), and the routine sets to standby until the output of oxygen sensor 16 increases to active voltage level Vth. Next, when the output of the oxygen sensor 16 exceeds the active level voltage Vth, the routine moves on to step 152 where it determines whether the electrical output of the oxygen sensor 16 is negative or not.

If combustible substances penetrate to the air electrode 19, they will burn, resulting in an oxygen deficiency at the air electrode 19. Accordingly, by the time the oxygen sensor 16 is activated, the oxygen concentration relationship between the air electrode 19 and the exhaust electrode 25 will be reversed, causing the electrical output of the oxygen sensor 16 to become negative. Thus, when the electrical output of the oxygen sensor 16 is detected as negative, the routine assumes that combustible substances have penetrated to the air electrode 19, and moves on to step 153 where the combustible substance penetration flag XO2INH is set to "1".

Conversely, if the electrical output for the oxygen sensor 16 is detected being more than 0 V in step 152, the routine assumes that combustible substances have not penetrated to the air electrode 19 and moves on to step 154 where it sets the combustible substance penetration flag X02INH to "0". Following this, it returns to step 152 and repeats determination on whether combustible substances have penetrated to the air electrode or not based on whether the electrical output of the oxygen sensor 16 is negative or not. At the point where the electrical output of the oxygen sensor 16 becomes negative, it assumes that combustible substances have penetrated to the air electrode 19 and proceeds to step 153 where it sets the combustible substance penetration flag X02INH to "1".

Figure 8:
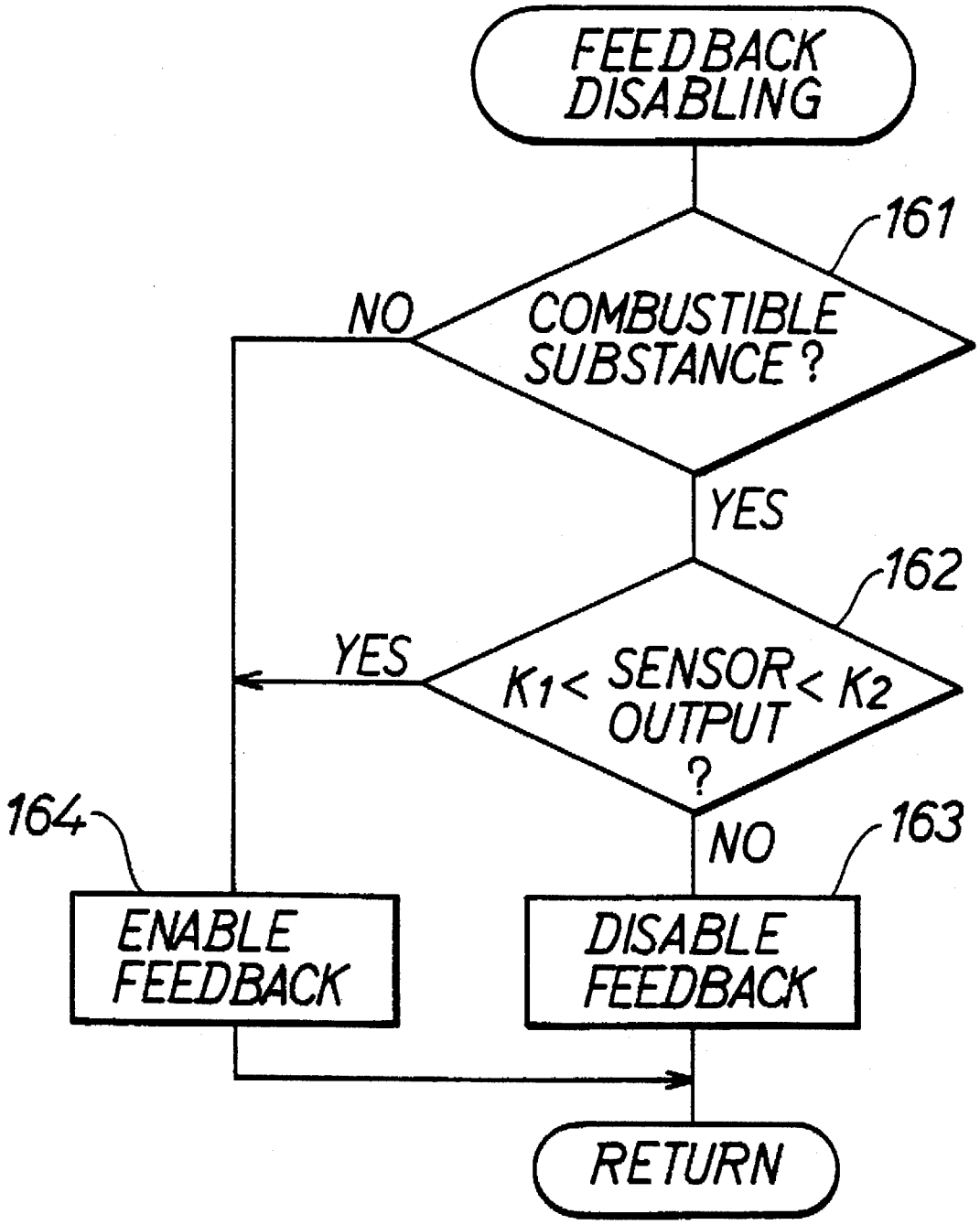
FIG. 8 is a flow chart showing the processing flow of feedback disabling routine.

When penetration of combustible substances is detected by the routines outlined in FIGS. 6 and 7 above, the A/F ratio feedback control is disabled by the routine shown in FIG. 8 until combustible substances have been completely burned (oxidized). In this routine, initially, in step 161 whether or not combustible substances have penetrated the air electrode 19 is detected based on whether or not the combustible substance penetration flag XO2INH is set to "1". If combustible substances have not penetrated to the air electrode 19, the routine moves on to step 164 and enables the A/F ratio feedback control.

Conversely, if the routine detects in step 161 that combustible substances have penetrated to the air electrode 19, it moves on to step 162 and detects whether the output for the oxygen sensor 16 is within the normal output range (K1<sensor output<K2) or not. If the sensor is within the normal output range, the routine assumes that combustible substances have already burned out, and proceeds to step 164 where it enables A/F ratio feedback control and sets the F/B flag to "1". If the output for oxygen sensor 16 is detected as being out of the normal output range in step 162, the routine moves to step 163 where it disables the A/F ratio feedback control and sets the F/B flag to "0".

Figure 9:
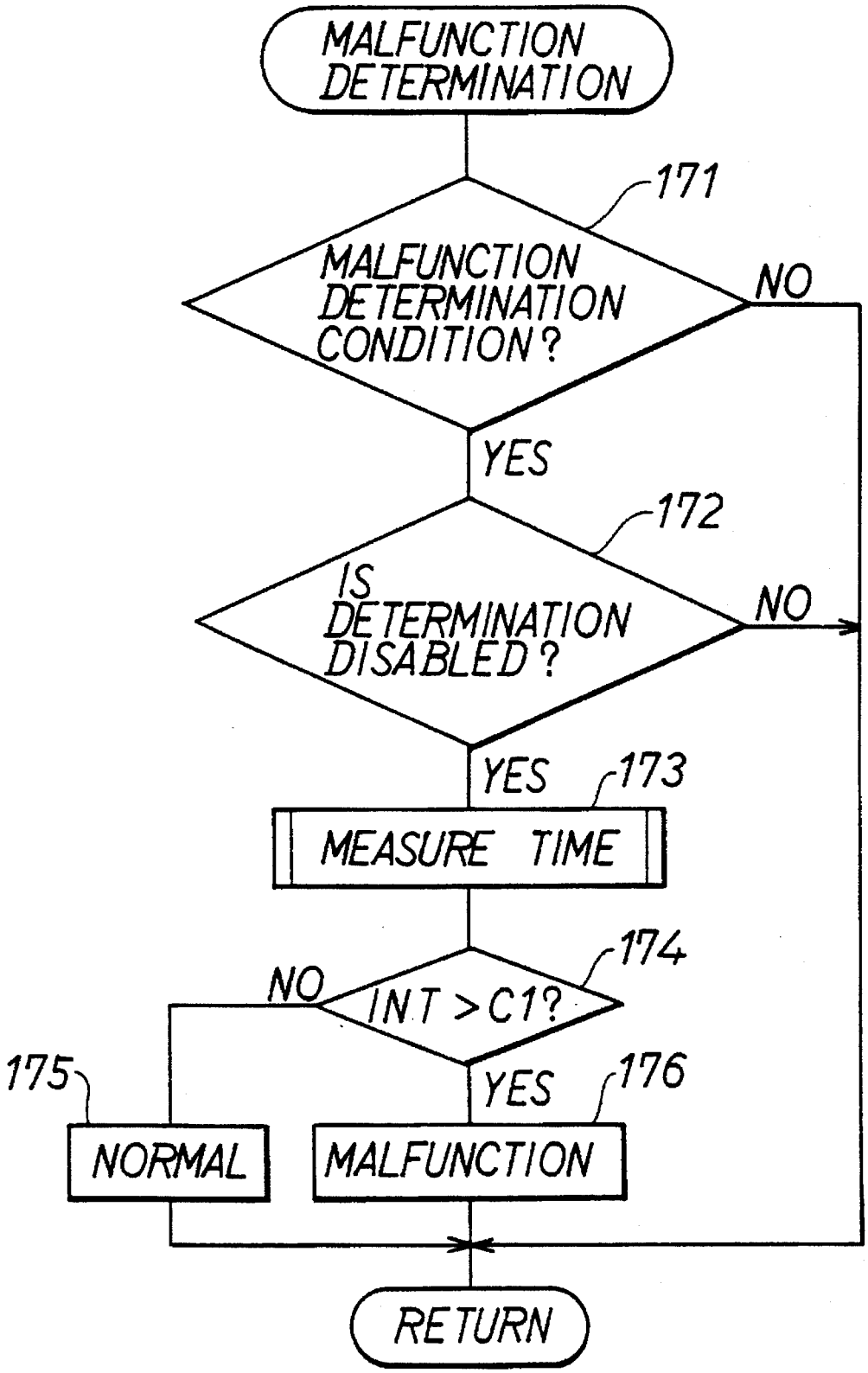
FIG. 9 is a flow chart showing the processing flow of malfunction determination routine.
Figure 10:
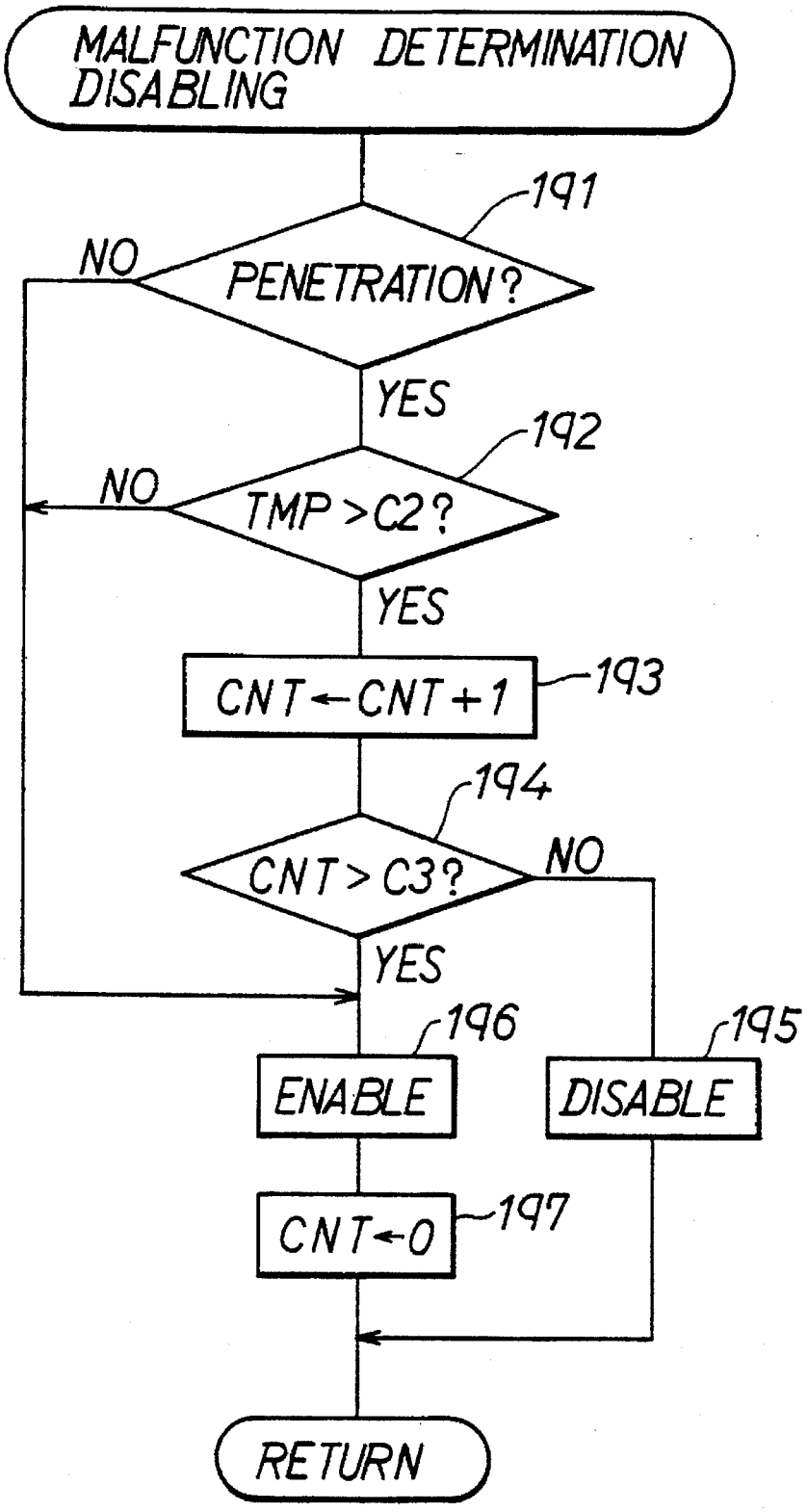
FIG. 10 is a flow chart showing the processing flow of malfunction determination disabling routine.

Also, the sensor malfunction determination means 30 shown in FIG. 1 determines whether the oxygen sensor 16 is malfunctioning or not using the routine in FIG. 9. In this routine, initially at step 171, it determines whether the malfunction determination conditions are met or not. The malfunction determination condition here is that the oxygen sensor 16 must be activated at a high temperature and the engine coolant temperature must exceed the specified temperature. If the malfunction detection condition is met, the routine moves on to step 172 and determines whether the malfunction determination is disabled or not by the malfunction determination disable processing routine outlined in FIG. 10.

With the malfunction determination disable processing routine, initially, in step 191, the routine determines whether or not combustible substances have penetrated to the air electrode 19 based on whether or not the combustible substance penetration flag XO2INH is set to "1". If combustible substances have not penetrated to the air electrode 19, the routine moves on to step 196 and enables malfunction determination. Conversely, if it determines that combustible substances have penetrated to the air electrode 19 in step 191, the routine moves to step 192 where it determines whether the engine coolant temperature TMP is higher than a specified temperature C2 (e.g. 90° C.) or not. If TMP≦C2, the routine moves on to step 196 and enables malfunction determination. When TMP≦C2, the temperature of the oxygen sensor 16 will not have exceeded the temperature at which the penetrating combustible substances burn, accordingly, an oxygen deficient condition will not have been created at the air electrode 19.

In contrast to the above, if TMP>C2 is determined in step 192, the temperature of the oxygen sensor 16 can be assumed to have risen to the combustion temperature for combustible substances that have penetrated to the air electrode 19, and the routine moves on to step 193 where it increments timer CNT by "1" and calculates the burning time for combustible substances. Next, in step 194, it determines whether the value of timer CNT has reached a specified time C3. If it has not reached C3, the routine determines that combustible substances have not yet been burned and proceeds to step 195 where it disables malfunction determination function. Thus, C3 is set to a sufficient time for burning off combustible substances. If the timer counter CNT reaches C3, the routine determines that all the combustible substances will have been burned off, then moves to step 196 where it enables malfunction determination and resets timer CNT (step 197) to "0".

The processing in steps 192 to 194 above is executed by oxygen deficiency determination means 32 for determining whether the oxygen deficiency state has been eliminated. All of these functions of the means 32, 12, 17 and 30 are performed by the software for the engine control using a microprocessor.

Figure 11:
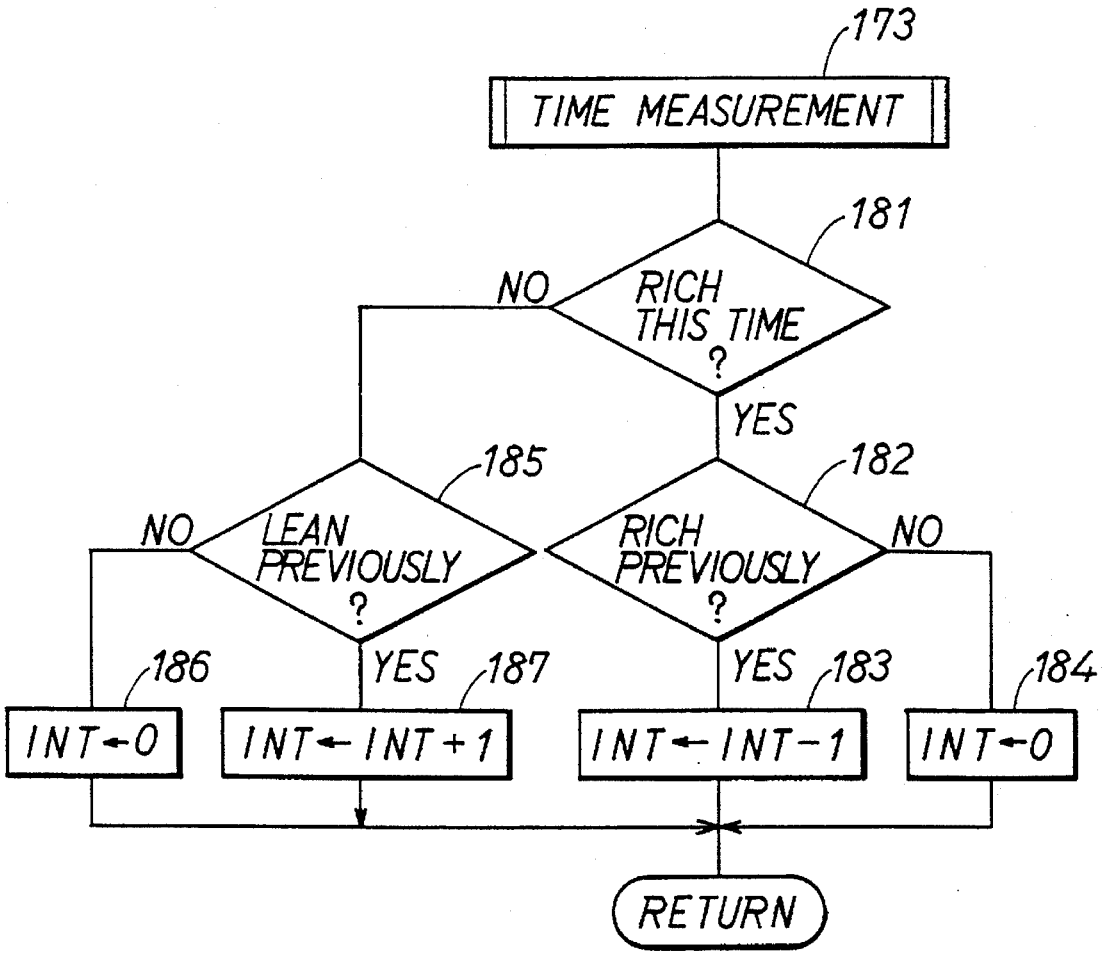
FIG. 11 is a flow chart showing the processing flow of time measurement routine.

If it is determined that the malfunction determination function has been disabled by the malfunction determination disabling processing routine, the time measurement processing shown in step 173 in FIG. 9 is performed. In this time measurement processing shown in detail in FIG. 11, the routine determines in step 181 whether the current A/F ratio is rich or lean. If it is rich, the routine also determines whether the previous A/F was rich or not (step 182), and if this is also rich, the timer counter INT increments by "1" (step 183). If the previous A/F ratio is lean, however, timer INT is cleared to "0" (step 184). Conversely, if the routine determines that the current A/F ratio is lean in step 181, it also determines whether the previous A/F ratio is rich or lean, and if it is lean, it increments the timer INT by "1" (step 187), and clears the timer counter INT to "0" (step 186) if it is rich previously.

By performing the processing mentioned above, each period of time INT while the output of the oxygen sensor 16 remains as rich and lean are measured. If the time INT continues in excess of a specified time C1, the result of determination in step 174 shown in FIG. 9 becomes "Yes" and the routine moves on to step 176, where it determines that the oxygen sensor 16 is malfunctioning and sets the fail flag to "1". After this, it transmits the malfunction signal to indication or warning means 31 shown in FIG. 1 to light an indicator lamp, etc., so as to indicate malfunction of the oxygen sensor 16. Conversely, if the measured time INT is less than the specified time C1 in step 174, the process proceeds to step 175, and determines that the oxygen sensor 16 is normal and sets the fail flag to "0".

Figures 12A, 12B, 12C, 12D, 12E, 12F:
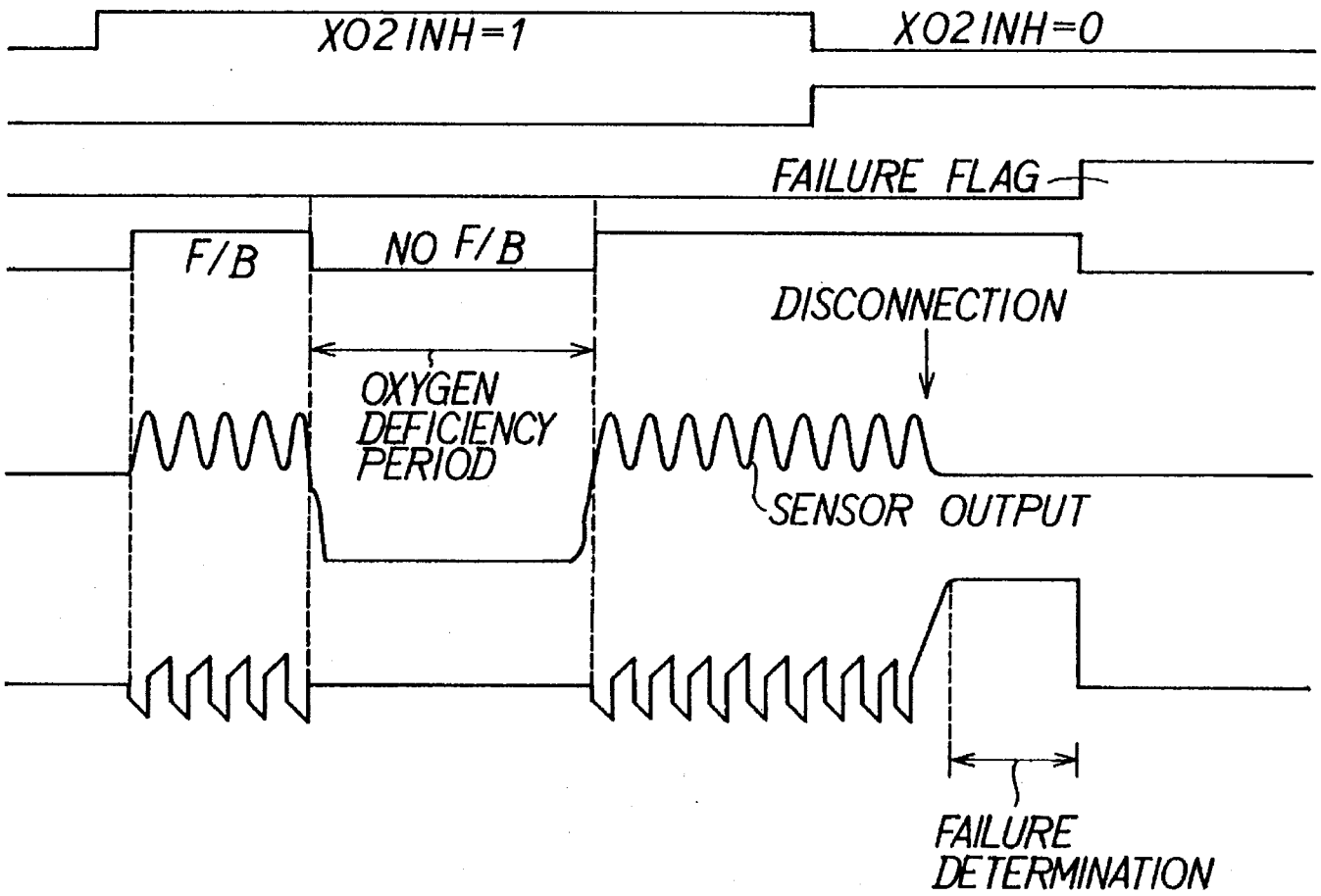
FIGS. 12A to FIG. 12F are time charts of operation of the first embodiment.

FIGS. 12A to 12F are timing charts of the above processing. In FIG. 12B, the conditions for eliminating the oxygen deficiency are met when the combustible substance penetration flag XO2INH switches from "1" to "0" as shown in FIG. 12A. During the oxygen deficiency period, detection of the output of the oxygen sensor 16 is halted. At the same time, the A/F ratio feedback control (FAF calculation) is also stopped as shown in FIG. 12D. When a malfunction such as a severed wire or disconnection, etc., occurs as shown in FIG. 12E after the oxygen deficiency period is over, the routine detects that the malfunction has occurred as shown in Figires.

According to the embodiment explained above, whether or not the oxygen sensor 16 is malfunctioning is detected based on the output of the oxygen sensor 16. In this instance, whether combustible substances penetrate to the air electrode 19 or not is determined based on either the estimated amount of fuel adhering to the oxygen sensor 16 or the output of the oxygen sensor 16. When penetration of combustible substances is determined, the malfunction determination function is disabled until the specified conditions are met (i.e., all combustible substances penetrating to the air electrode 19 are burned completely). This is to prevent an erroneous malfunction determination of the oxygen sensor 16 due to the penetration of combustible substances and to improve malfunction determination accuracy.

In the embodiment, malfunction determination is disabled (i.e., malfunction determination is not performed) when penetration of combustible substances is determined. However, in such instances, the malfunction determination can also be made but, even if penetration of combustible substances is determined, issuing a malfunctioning determination result is actually canceled.

To make malfunction determination pending (i.e., not to disable malfunction determination when combustible substances penetrate to the air electrode), when penetration of combustible substances is determined, malfunction indication by the indication means 31 is halted until the oxygen deficient state at the air electrode 19 disappears. This prevents erroneous indication of malfunction when combustible substances have penetrated to the air electrode. When oxygen deficiency is later eliminated, malfunction determination is performed again and if the oxygen sensor 16 is determined as actually malfunctioning, the indication means 31 issues the malfunction warning for the first time. If the oxygen sensor 16 is determined as operating normally, it stops issuing malfunction warning.

If it is determined as malfunctioning, the malfunction information is memorized in the RAM (not illustrated) and backed up by the battery to use for diagnosis, etc., later. However, in case the oxygen deficiency exists, the malfunction information memorized in the RAM during the oxygen deficient condition is cleared when the oxygen sensor is determined as operating normally by the later malfunction determination after the oxygen deficient condition has disappeared. This prevents erroneous malfunction information which was memorized during the oxygen deficient condition from being maintained in the RAM.

In the embodiment described above, the conditions for deciding the period of time to disable malfunction determination are that the specified time C3 must elapse after the engine coolant temperature TMP has exceeded the specified temperature C2. "The engine coolant temperature has exceeded the specified temperature C2" means that "the oxygen sensor 16 heats up to the temperature level at which combustible substances on the air electrode 19 will burn." "The specified time C3 must elapse" means that "all combustible substances must have completely burned." More precisely, the combustion temperature for combustible substances penetrating to the air electrode and time required for them to completely burn need be determined. The combustion temperature at the air electrode 19 can be detected by a temperature sensor installed actually on the oxygen sensor 16. However, various devices can be used for determining the combustion temperature as exemplified below.

(1) If the oxygen sensor 16 is equipped with the heater 28, the oxygen sensor 16 will heat up and become operative before the engine coolant temperature increases. Also, exhaust heat is applied to the oxygen sensor 16. Thus, the temperature of the oxygen sensor 16 can be estimated based on the heat from the heater and from exhaust heat. In addition, the temperature of the oxygen sensor 16 can be estimated based on the heat calories applied to the oxygen sensor 16 based on the warming-up or power-up time of the heater 28, the engine coolant temperature, the engine load and the exhaust gas temperature. In such instances, it is not necessary to consider all factors (i.e., power supply time to the oxygen sensor 16 engine coolant temperature, engine load and exhaust gas temperature) to estimate the temperature of the oxygen sensor 16. Only one or two factors needs to be taken into account when estimating the temperature of the oxygen sensor 16. Thus, the temperature of the oxygen sensor 16 can be determined without installing a temperature sensor.

(2) The output of the oxygen sensor 16 is 0 V when the temperature of the sensor is low. When the sensor heats up to high temperature levels, however, it is activated and the specified output voltage higher than 0.5 V can be obtained. Therefore, by monitoring the output of the oxygen sensor 16 to determine whether the output for the sensor achieves the specified voltage or not (i.e., whether the oxygen sensor 16 is active or not, whether or not the oxygen sensor 16 has heated up to the specified temperature or not) can also be detected.

Also, determination of the time required for combustible substances to burn completely is not limited to measurement of the specified time. In other words, malfunction determination needs to be disabled only while the oxygen deficiency exists at the air electrode 19 of the oxygen sensor 16. Thus, after the oxygen sensor 16 is detected as having heated up to the specified temperature to become activated by the device (1) or (2) above, whether or not all combustible substances are completely burned is determined based on whether the electrical output of the oxygen sensor 16 returns to the normal output range or not, so that the malfunction determination function can again be enabled. More precisely, when all combustible substances penetrating to the air electrode 19 are burned completely, the oxygen concentration at the air electrode 19 is restored to the normal value (i.e., the oxygen concentration in the air) and the output of the oxygen sensor 16 returns to the normal output range. Therefore, when the output of the oxygen sensor 16 returns to the normal output range, it can be determined that all combustible substances penetrating to the air electrode 19 have been completely burned.

In the combustible substance penetration determination routine in FIG. 6, whether or not fuel has penetrated to the air electrode 19 of the oxygen sensor 16 is determined based on the amount of residual fuel remaining in the oxygen sensor 16 when the ignition switch is turned off while the fuel adhering to the oxygen sensor 16 on startup of the engine 11 has not yet evaporated. As described above, some time is required from when fuel adheres to the surface of exhaust electrode 25 of the oxygen sensor 16 until it penetrates to the air electrode 19. By a timer which measures the time from when ignition switch is turned off until the engine 11 is restarted, whether or not fuel has penetrated to the air electrode 19 of the oxygen sensor 16 can be determined based on the amount of fuel adhering to the oxygen sensor 16 and the time counted by the timer.

Next, the second embodiment of this invention will be described using FIGS. 13 through 16F. First, in step 200 in FIG. 13, whether or not malfunction determination conditions are met is determined. This determination is executed by the routine in FIG. 15. Initially whether A/F feedback control is being performed or not is detected in step 201. If the A/F feedback control is not being performed, then it is determined that malfunction determination conditions are being met (step 205). If the A/F feedback control is being performed, the routine proceeds to steps 202 and 203. Also, if the A/F ratio feedback correction factor FAF is higher than the upper limit KU or below the lower limit KL, i.e. FAF is not in the normal range, it is considered that malfunction determination conditions are being met (step 205). If KL<FAF<KU, malfunction determination conditions are not being met (step 204).

Figure 13:
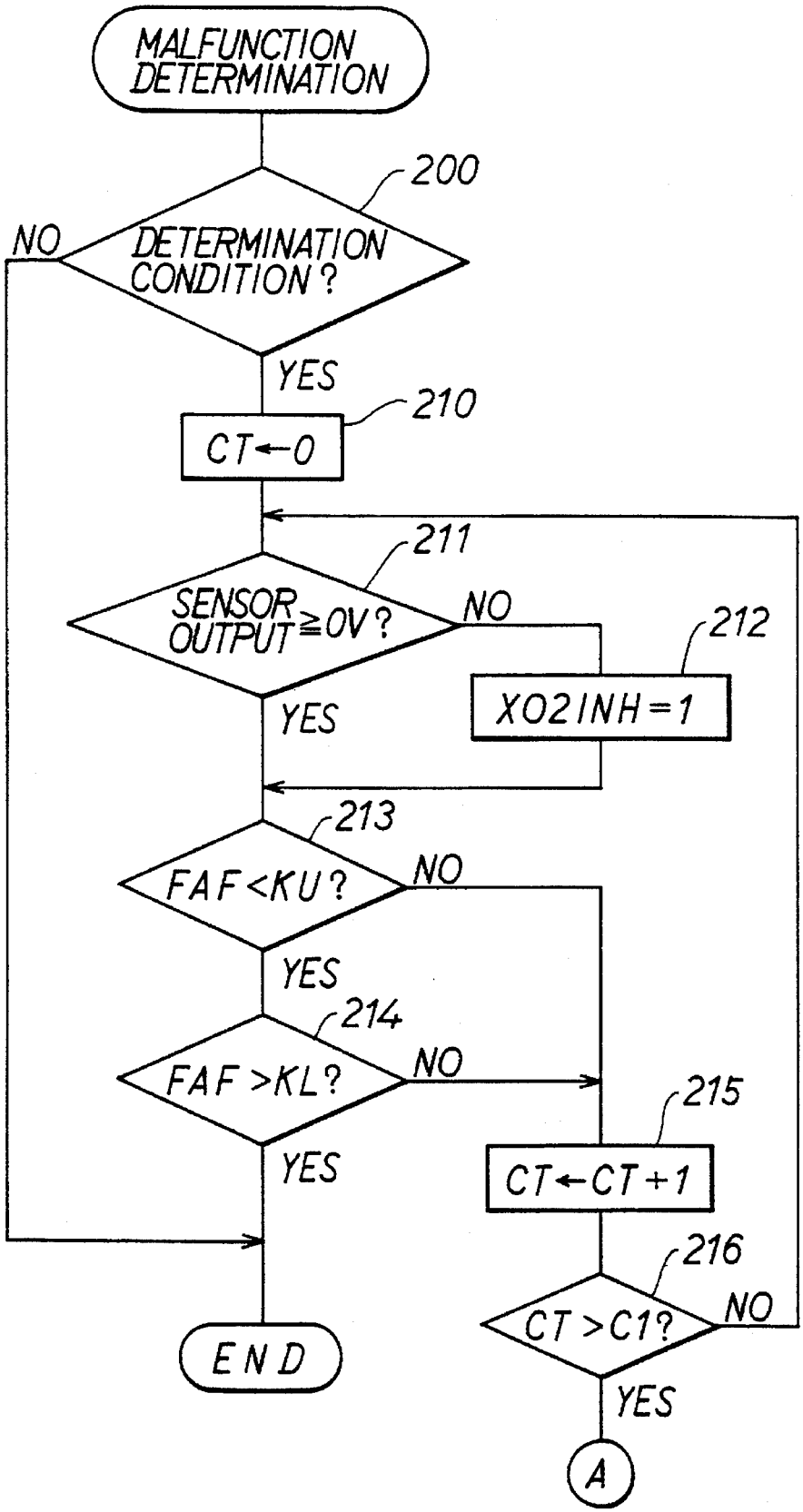
FIG. 13 is a flow chart showing the processing flow of the malfunction determination routine according to the second embodiment of this invention.

When malfunction detection conditions are not met, the malfunction determination routine in FIG. 13 ends. On the other hand, if malfunction determination conditions are met, the routine moves to step 210 and sets a timer CT (time that FAF is unchanged from KU or KL) to "0". Next, in step 211, it is determined whether the electrical output of the oxygen sensor 16 exceeds 0 V or whether it is of negative potential. If it is negative, the routine assumes that combustible substances have penetrated to the air electrode 19 of the oxygen sensor 16 and sets the combustible substance penetration detection flag XO2INH to "1" (step 212).

In steps 213 through 216, the duration of time when the A/F ratio feedback correction factor FAF exceeds the upper limit KU or remains below the lower limit KL is counted by F/B detection timer CT. If the timer count reaches the specified value C1, the processing in steps 210 through 216 is repeated until the timer count reaches C1. If the determination in both steps 213 and 214 is "Yes" (i.e., KL<FAF<KU), the electrical output of the oxygen sensor 16 is restored to the normal range, and the malfunction determination routine ends.

Figure 14:
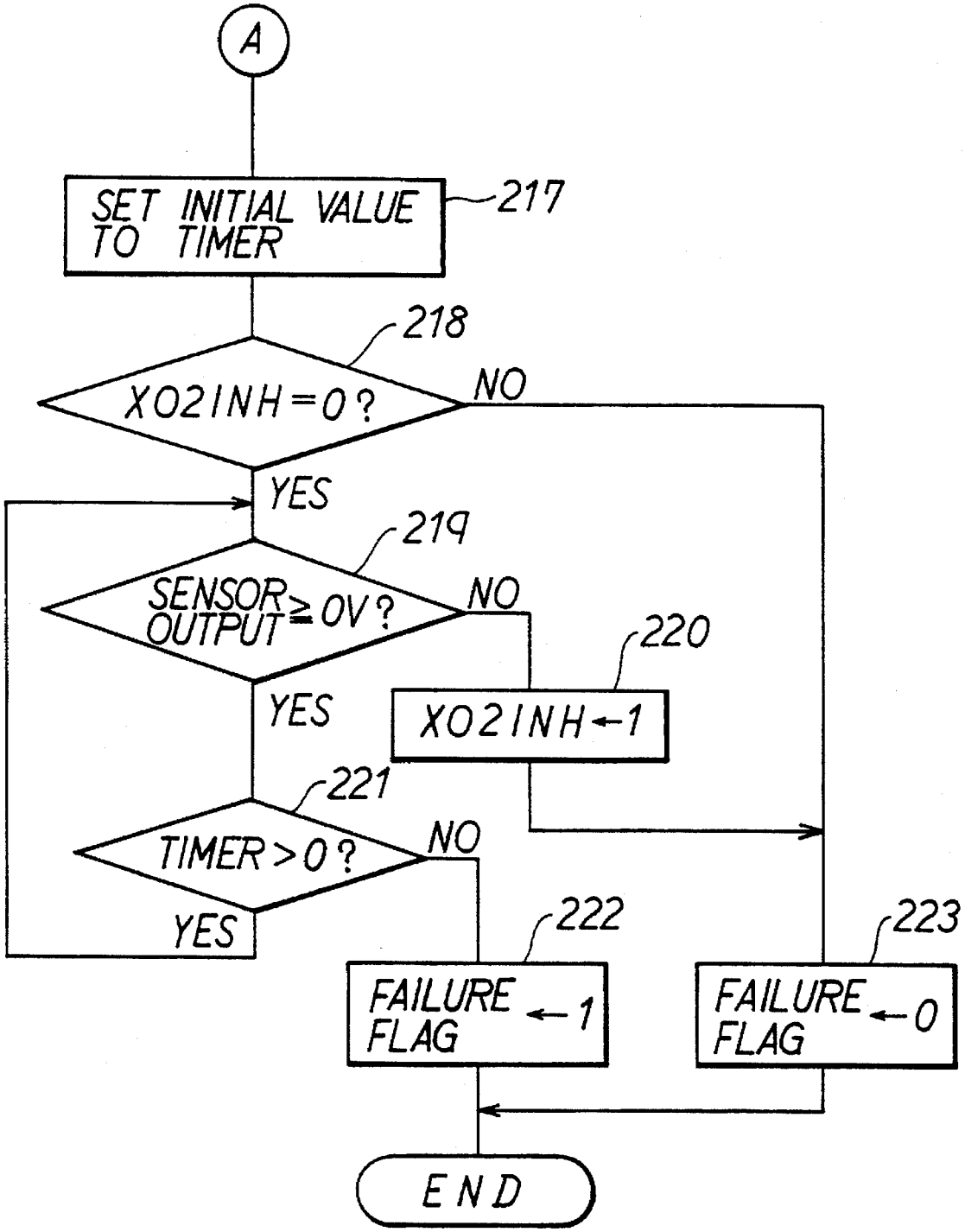
FIG. 14 is a flow chart showing the processing flow of the malfunction determination.
Figure 15:
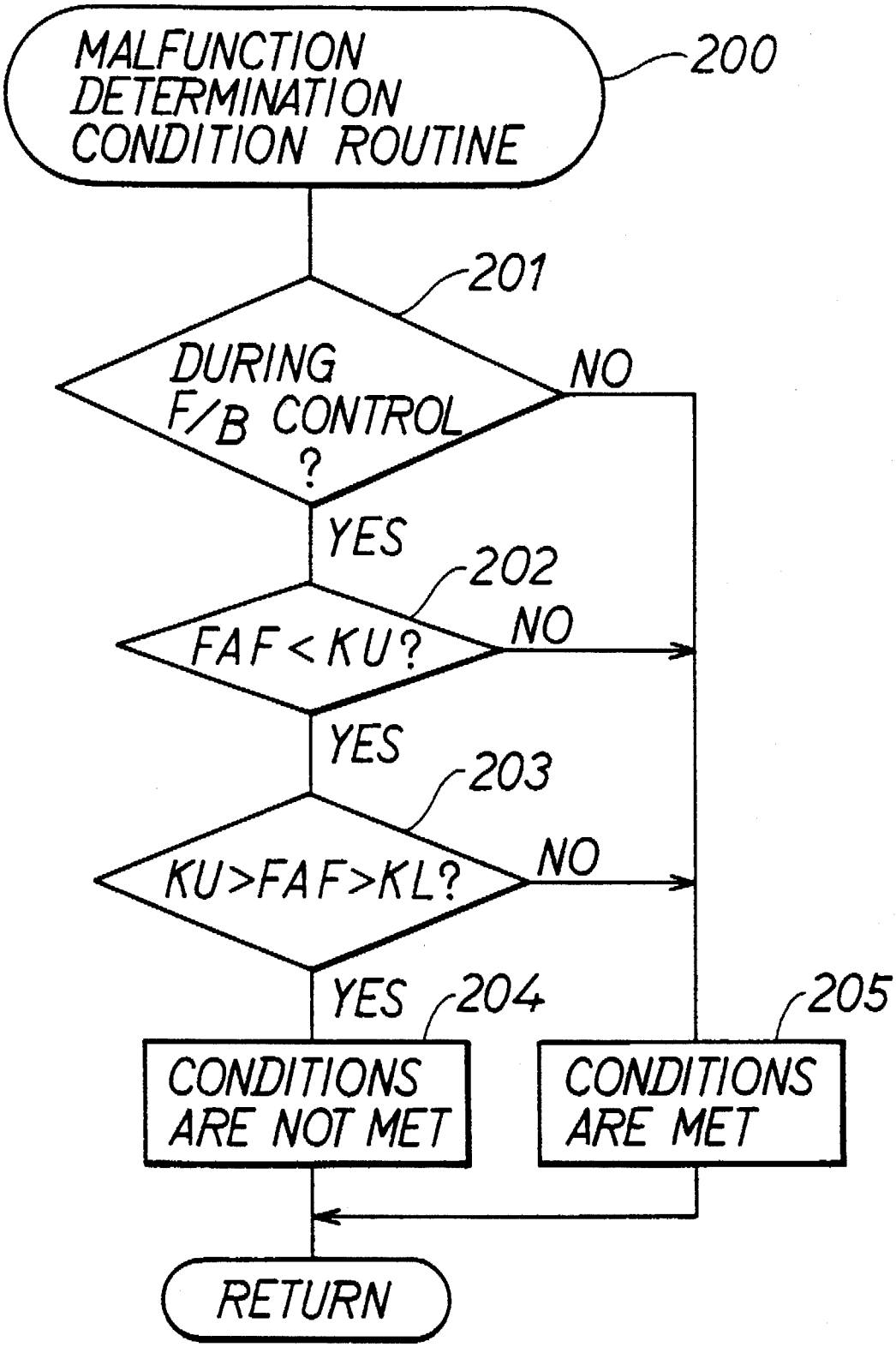
FIG. 15 is a flow chart showing the processing flow of the routine which determines whether or not malfunction determination conditions are met.

On the other hand, if the F/B timer CT reaches the specified value C1 before the output for the oxygen sensor 16 returns to the normal range, the routine proceeds to malfunction determination processing in step 217 and subsequent steps in FIG. 14. With this processing, the timer sets on initial value so as to disable detection of malfunction of the oxygen sensor for the specified period of time after the F/B detection timer CT reaches the specified value C1, then the timer counts down. Following this, the routine determines whether the combustible substance penetration detection flag XO2INH is set to "0" or not, (i.e., or in other words, determines whether combustible substances have penetrated to the air electrode 19 or not). If combustible substances are determined (XO2INH=1), the process proceeds to step 223, sets the failure flag to "0", determines that the oxygen sensor 16 is not malfunctioning and ends the malfunction determination routine.

On the other hand, if no combustible substances are detected (XO2NIH=0), in steps 219 and 221 the routine monitors whether the sensor electrical output becomes negative or not until the timer set in step 217 becomes "0". If the output of the oxygen sensor 16 is detected as being negative before the timer becomes "0", processing assumes that combustible substances have penetrated to the air electrode 19 of the oxygen sensor 16, sets the XO2INH flag to "1" (step 220), and proceeds to step 223 where it sets the failure flag to "0". Thus, the processing does not determine that the oxygen sensor 16 is malfunctioning, then ends the malfunction determination routine.

Conversely, if the timer becomes "0" while the output of the oxygen sensor 16 remains above 0 V, the routine determines that the oxygen sensor 16 is malfunctioning. It then moves on to step 222 and sets the failure flag to "1" and ends the malfunction determination routine.

If the malfunction determination routine is ended via step 214 and 223 as described above and the XO2INH flag is set to "1", the malfunction determination operation will remain disabled until it is determined that oxygen deficiency is eliminated by the oxygen deficiency determination means 32.

Also, with A/F ratio feedback processing, feedback is enabled by steps 200 to 216 wherein it is determined that malfunction is existing. However, on proceeding from step 216 to step 217, the malfunction determination standby state is set, and A/F ratio feedback control is stopped to prevent the A/F ratio from becoming over too rich or too lean.

Figures 16A, 16B, 16C, 16D, 16E, 16F:
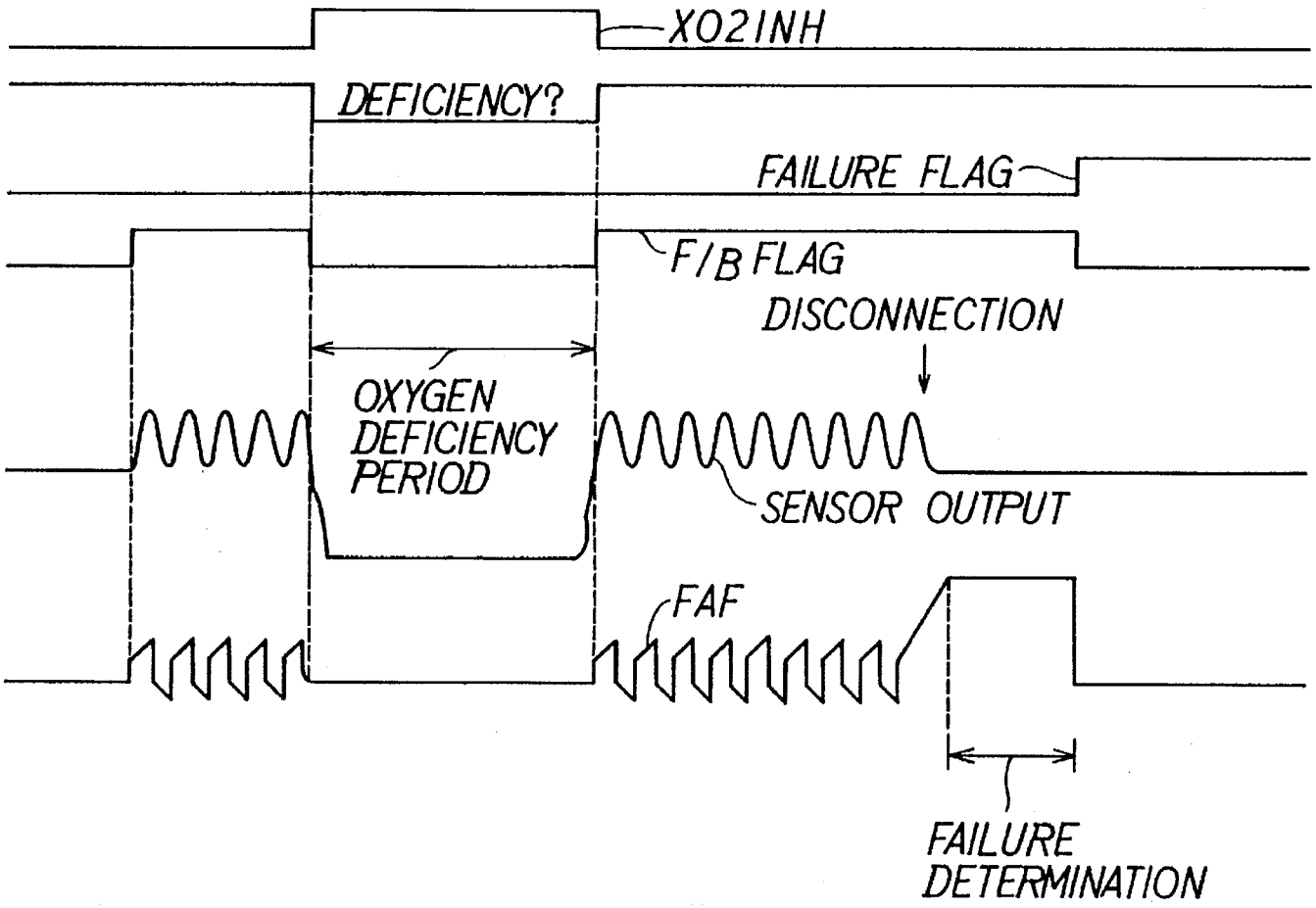
FIGS. 16A to FIG. 16F are time charts showing the operation of the second embodiment.

FIGS. 16A through 16F are timing charts for of the second embodiment described above. In FIG. 16B, conditions for eliminating of the oxygen deficiency have not been met ("0") corresponds to the combustible substance penetration flag XO2INH being set to "1". This period corresponds to the oxygen deficiency period. After the oxygen deficiency time has passed, malfunction is determined when failures such as severing or disconnection of wires, etc. occur.

In both the first and second embodiments, penetration of combustible substances is determined. Based on the fact that while the oxygen deficiency at the air electrode 19 has not been eliminated the electrical output of the oxygen sensor 16 will remain negative until all combustible substances penetrating to the air electrode 19 of the oxygen sensor 16 are completely burned, malfunction determination can be disabled as long as the oxygen sensor electrical output remains negative.

Figure 17:
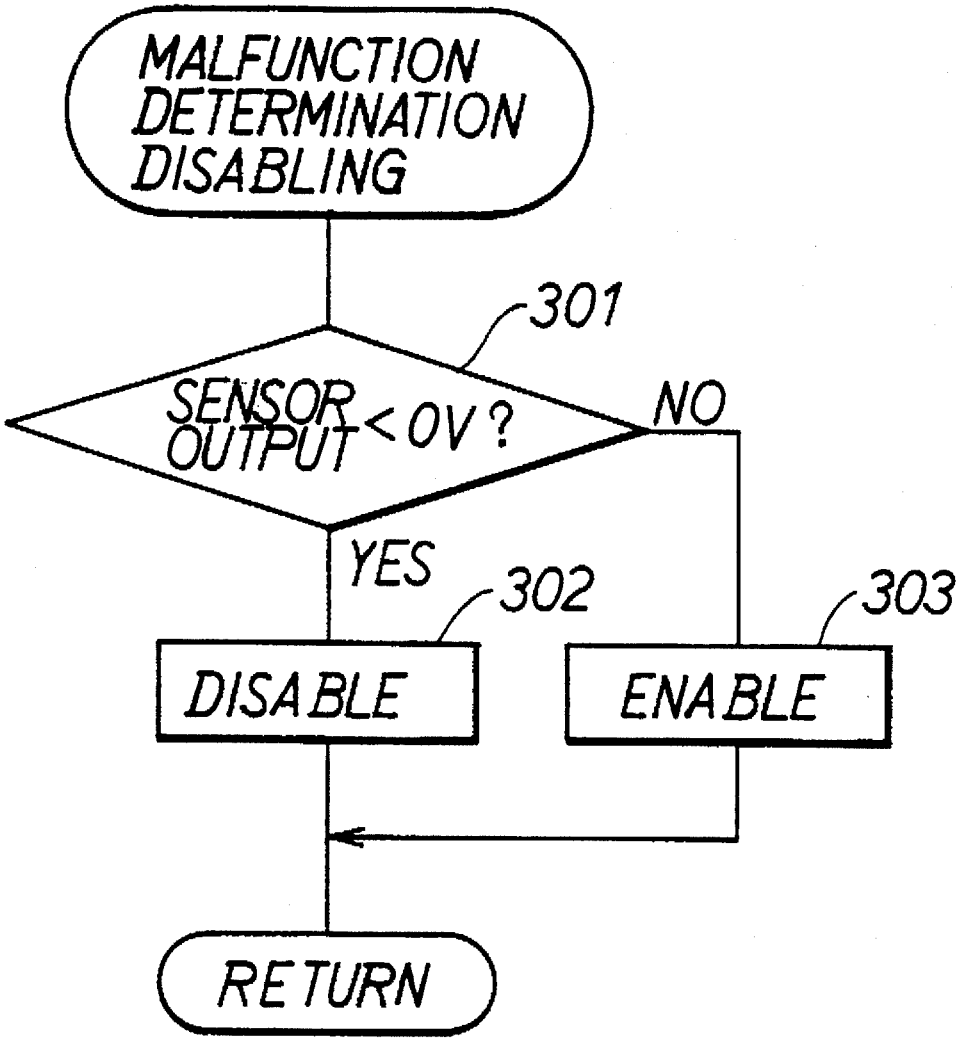
FIG. 17 is a flow chart showing the processing flow of the malfunction determination disabling routine according to the third embodiment of this invention.

FIG. 17 is the third embodiment which realizes the above modification. In step 301, the electrical output of the oxygen sensor 16 is compared with 0 V to detect whether the output potential is negative or positive. If it is negative, the routine moves on to step 302 and malfunction determination is disabled. This makes it possible to disable malfunction determination by simple processing until the combustible substances penetrating to the air electrode 19 have completely burned. On the other hand, if the sensor electrical output is positive, malfunction determination is enabled and malfunction detection is performed by the malfunction determination routine shown in FIG. 9.

However, in the above instance also, the malfunction determination operation is not necessarily disabled; only the malfunction determination result can be made canceled.

The present invention having been described above should not be limited to the disclosed embodiments but may be modified in many other ways without departing from the spirit of the invention.

What is claimed is:

1. An oxygen concentration detection device comprising:

an oxygen sensor equipped with an exhaust gas electrode which makes contact with exhaust gases and an air electrode which makes contact with air in order to detect oxygen concentration;

malfunctioning detecting means for detecting whether the oxygen sensor is malfunctioning or not based on an oxygen sensor output;

means for determining whether oxygen deficiency at a side of the air electrode of the oxygen sensor is eliminated or not; and means for canceling a malfunction detection made by the malfunction detecting means, when the oxygen deficiency at the side of the air electrode of the oxygen sensor determined by the determining means is not eliminated, until the oxygen deficiency is eliminated.

2. An oxygen concentration detection device according to claim 1, further comprising:

means for detecting whether or not combustible substance has entered into the side of the air electrode of the oxygen sensor; and means for allowing an operation of the determining means when the combustible substance is detected by the combustible substance detecting means.

3. An oxygen concentration detection device according to claim 2, further comprising:

means for determining an amount of fuel injected at engine startup; and said combustible substance determining means determining whether or not the injected fuel has entered into the side of the air electrode of the oxygen sensor based on a determination result of the fuel amount determining means.

4. An oxygen concentration detection device according to claim 2, wherein the combustible substance determining means determines whether or not the combustible substance has entered into the side of the air electrode of the oxygen sensor based on whether the output of the oxygen sensor is negative or positive.

5. An oxygen concentration detection device according to claim 2, wherein the combustible substance determining means determines whether or not the combustible substance has entered into the side of the air electrode of the oxygen sensor based on whether or not the output of the oxygen sensor remains below a specified level for a specified period of time after an oxygen sensor temperature has reached a specified temperature.

6. An oxygen concentration detection device according to claim 2, wherein the oxygen deficiency determining means determines elimination of the oxygen deficiency by a time passed after the combustible substance detecting means detects entrance of the combustible substance.

7. An oxygen concentration detection device according to claim 1, further comprising:

means for indicating a malfunction of the oxygen sensor when the oxygen sensor is detected as malfunctioning by the malfunction detecting means; and means for canceling an indication of the malfunction when it is determined that the oxygen deficiency at the side of the air electrode of the oxygen sensor is existing.

8. An oxygen concentration detection device according to claim 1, further comprising:

means for memorizing an information of the malfunction; and means for clearing when the oxygen sensor is determined as operating normally by the malfunction detecting means after the oxygen deficiency has been eliminated the information stored previously in the memoring means.

9. An oxygen concentration detection device according to claim 1, wherein the oxygen deficiency determining means determines a temperature of the oxygen sensor based on at least one of an oxygen sensor heating time, an engine coolant temperature, an exhaust gas temperature, and an engine load, and determines if the oxygen deficiency determined at the side of the air electrode of the oxygen sensor has been eliminated based on the determination of the temperature.

10. An oxygen concentration detection device according to claim 1, wherein the oxygen deficiency determining means determines if the oxygen deficiency at the side of the air electrode of the oxygen sensor has been eliminated or not based on whether or not a specified time has passed after the temperature of the oxygen sensor has reached the specified temperature.

11. An oxygen concentration detection device according to claim 1, wherein the oxygen deficiency determining means determines if the oxygen deficiency has been eliminated or not based on whether or not the oxygen sensor output restores to a normal range after the temperature of the sensor is detected as having reached the specified temperature.

* * * * *